United States Patent [19]

Flynn et al.

[11] Patent Number: 4,959,873

[45] Date of Patent: Sep. 25, 1990

[54] TRANSMISSION LINE SWITCH

[75] Inventors: Stephen J. Flynn, Watford; Gerard King, Croxley Green, both of England

[73] Assignee: The Marconi Company Limited, England

[21] Appl. No.: 371,714

[22] Filed: Jun. 27, 1989

[30] Foreign Application Priority Data

Jul. 8, 1988 [GB] United Kingdom ..... 8816273
Jan. 20, 1989 [GB] United Kingdom ..... 8901278

[51] Int. Cl.[5] ..... H04B 1/18; H01P 1/15

[52] U.S. Cl. ..... 455/303; 307/243; 307/571; 330/295; 333/104; 455/3

[58] Field of Search ..... 333/103, 104, 101; 307/243, 571; 330/295; 455/3, 303

[56] References Cited

U.S. PATENT DOCUMENTS 4,399,439 8/1983 Upadhyayula ..... 333/101 X
4,472,691 9/1984 Kumar et al. ..... 333/104 X
4,626,806 12/1986 Rosar et al. ..... 333/104
4,803,443 2/1989 Takagi et al. ..... 330/295
4,897,563 1/1990 Bahl ..... 333/101 X

OTHER PUBLICATIONS

Extract from "Microwave Field Effect Transistors-Theory, Design and Applications", by R. S. Pengelly.

*Primary Examiner*—Paul Gensler
*Attorney, Agent, or Firm*—Kirschstein, Ottinger, Israel & Schiffmiller

[57] ABSTRACT

A transmission line switch allows a single output line (3) to be switched to one of two or more input lines (1,2) to which it is permanently connected at a common junction (4). Each input line (1,2) has an associated amplifier stage (10) which can be biased in a normal high gain ('on') state, or in an isolation ('off') state. Suitable biasing in the 'off' state ensures that the amplifier stage output presents a low impedance to its own input line, the length (L) of which is chosen to reflect a high impedance at the junction (4) with the other lines. Correct design enables the return loss and insertion loss of the 'on' path to be kept to low values while simultaneously offering a high insertion loss to the 'off' path signals.

10 Claims, 2 Drawing Sheets

TRANSMISSION LINE SWITCH

BACKGROUND OF THE INVENTION

1. Field of the Invention

This invention relates to a transmission line switch and, in particular, to a switch for the transmission with gain of a signal from one of a plurality of input lines connected to a common output line.

2. Description of Related Art

For many years the PIN diode has dominated as the control element in switches for microwave circuits. More recently attention has focussed on the use of single- and dual-gate FETs in the design of fast switches. Configurations using FETs include series and shunt mounted arrangements, both relying on the drain-source resistance of the device in the 'on' state as a low impedance path, either for transmission of the signal (series configuration), or as a shunt across the line (shunt configuration). Combinations of series and shunt mounted devices are also known, which further improve isolation in the 'off' state of the switch. All these arrangements provide a broadband (untuned) response. The insertion loss in the 'on' state can be reduced somewhat by the addition of appropriate tuning components. However, a diode or FET used as a switch in this way causes a degree of signal attenuation, a loss which adds to the noise figure of the overall system in which it is a part. Also, none of these configurations makes use of the amplifying capabilities of the FET device. In applications where a transmission line switch is at the front end of a microwave receiving system, where, for instance, the switch may be required to select one of two DBS (Direct Broadcast by Satellite), also known as satellite TV, broadcast signals having different polarizations, the performance of the switch in terms of noise figure, frequency response and isolation will have a profound effect on the quality of the signal available to the rest of the system. In such a case, the use of a FET device as a switch providing gain has the significant advantage that the noise figure of the switch, which, being at the front end of the receiving system, is the most significant stage in terms of noise performance, is substantially that of the amplifying circuit.

SUMMARY OF THE INVENTION

It is an object of the present invention to provide a transmission line switch having an improved noise performance compared to existing switches.

According to the invention, a transmission line switch in which a plurality of input lines are connected to a common output line at a junction, comprises in each input line an associated amplifying means, operable in an 'on' state to transmit a signal with gain exceeding unity, and in an 'off' state, in which the output impedance of the amplifying means is such that, in conjunction with the length of the input line between the associated amplifying means and the junction, the amplifying means in its 'off' state presents a high impedance at said junction.

The output impedance of the amplifying means in its 'off' state may be a low impedance relative to the characteristic impedance of the input lines.

Each amplifying means may include a FET device, matching networks to match the device to its associated input line, and biasing means to determine the state of the amplifying means.

The FET device may be a high electron mobility transistor (HEMT).

The input lines, output line and junction may be formed as stripline on a microstripline board.

The transmission line switch has a noise figure determined substantially by the noise figure of the amplifying means in its 'on' state.

The switch may include two input transmission lines, each carrying one of two orthogonally polarized satellite TV signals from the receiving horn of a microwave antenna, the amplifying means in i 'on' state constituting part of a receiver for these signals.

BRIEF DESCRIPTION OF THE DRAWINGS

A transmission line switch in accordance with the invention will now be described, by way of example, with reference to the accompanying drawings, in which.

DETAILED DESCRIPTION OF THE PREFERRED EMBODIMENT

Figure 1:
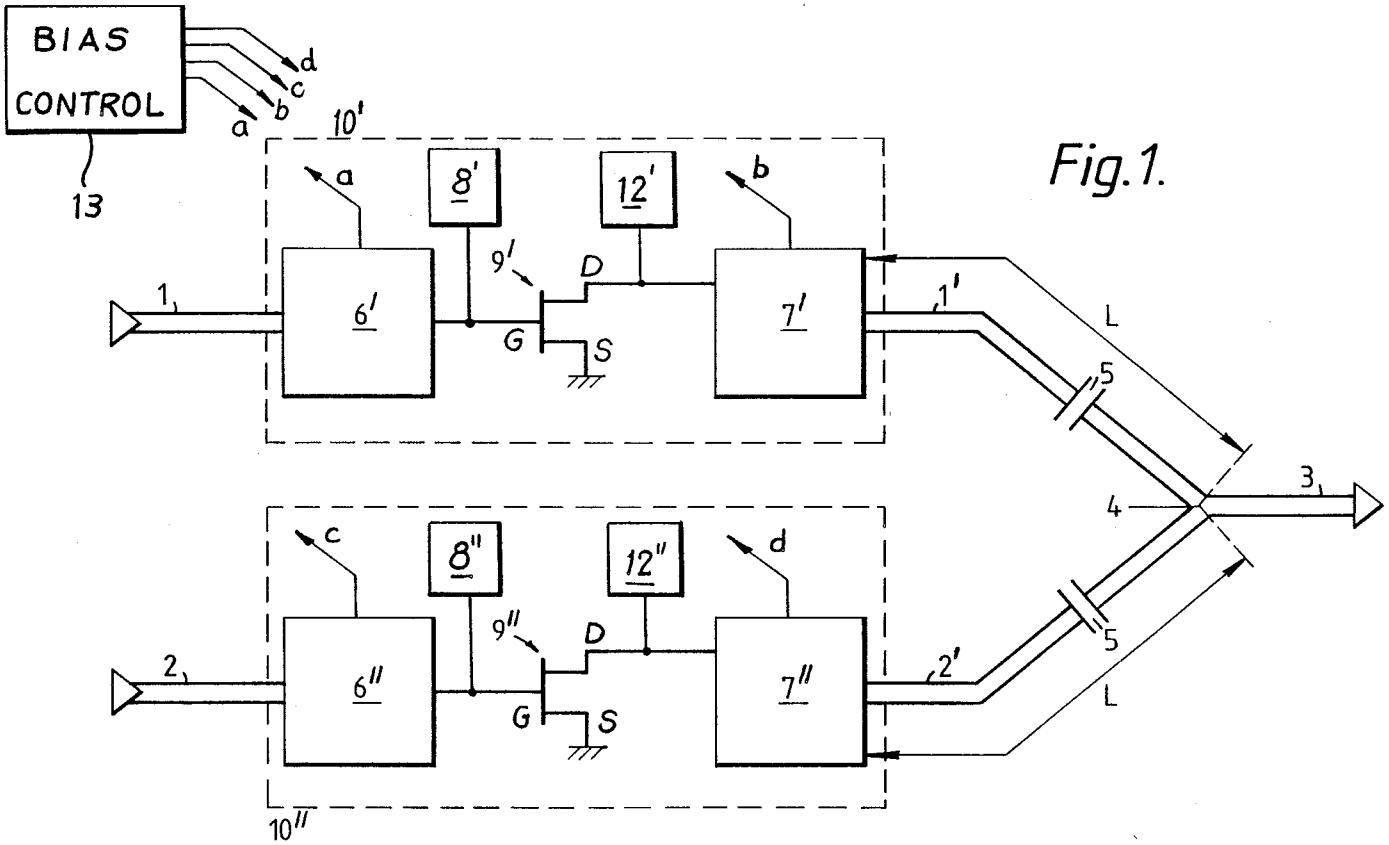
FIG. 1 is a schematic block diagram of a transmission line switch having two input lines.

Referring to FIG. 1, two input transmission lines 1,1' and2,2' each comprise two sections, a first line section 1,2 and a second line section 1',2'. The two second line sections 1',2' are permanently connected to a common output transmission line 3 at a junction 4. In the path of each transmission line, between the first and second line sections, there is connected an amplifying stage, 10' for line 1,1' and 10'' for line 2,2'. The two amplifying stages 10' and 10'' are identical. Thus, although the description that follows is restricted to the amplifying stage 10', it will be appreciated that the amplifying stage 10'' is in all aspects the same. The amplifying stage 10' comprises a FET device 9' and biasing networks 6' and 7', associated respectively with the gate terminal G and the drain terminal D of the FET device 9'. The biasing networks enable the FET device 9' to be operable in one of two states : a high gain 'on' state, in which the amplifying stage 10' amplifies a signal applied to it by means of the first line section 1; and an isolation or 'off' state, in which a signal applied to the first line section 1 is substantially attenuated at the output of the amplifying stage 10', and in which the device 9' has a low output impedance. The amplifying stage 10' also includes impedance matching networks 8' and 12'. The network 8', which is connected to the gate terminal G of the device 9', is designed to present the optimum noise source impedance to the device 9'. The network 12', which is connected to the drain terminal D of the device 9', matches the output impedance of the device 9' to the characteristic impedance of the input transmission line 1,1'.

Referring now to the whole of FIG. 1, in operation, two different signals are applied separately to the first line sections 1 and 2, one of which signals it is required to transmit or 'switch' to the output line 3, the other signal being essentially isolated from the output line 3 and the other input line. Assume, for example, that the signal applied to the first line section 1 is the wanted signal. In this case, the device 9' is biased in its 'on' state by control of its biasing networks 6' and 7', so that the signal emerging on the second line section 1' is an amplified version of the wanted signal applied to the first line section 1 The output impedance of the device 9' in its 'on' state is transformed by the matching network 12' into the characteristic impedance of the input line ,1,1'; this ensures maximum signal transfer from the output of the amplifying stage 10' to the second line section 1'. At the same time, the device 9'' in the amplifying stage 10'' of input line 2,2' is biased in the 'off' state by means of its biasing networks 6'' and 7''. Thus, the device 9'' provides no gain for the signal applied to first line section 2, and the signal is further attenuated by the low output impedance which the amplifier stage 10'' presents at its output to the second line section 2'.

At the junction 4, the wanted (amplified) signal on second line section 1' has a choice of two paths: the output transmission line 3, which presents the same characteristic impedance as the input lines at the junction 4, and the second line section 2'. Ideally, the wanted signal from the second line section 1' is transmitted solely to the output line 3, with no transmission of the wanted signal to the the 'off' state by means of its biasing networks 6'' and 7''. Thus, second line section 2'. Optimum transfer of the wanted signal to the output line 3, with maximum isolation between the second line sections 1' and 2', is achieved by arranging that the second line section 2' presents a very high impedance path to the wanted signal at the junction 4. The impedance presented by the second line section 2' should be high relative to the characteristic impedance presented by the output line 3, since it is the ratio of these two impedances which determines the insertion loss at the junction 4. The low output impedance presented by the device 9'' in its 'off' state can be transformed into a high impedance at the junction 4 by choosing a suitable length L for the second line section 2' between the output of the amplifying stage 10'' and the junction 4. When the length L of the second line section 2' is chosen appropriately the wanted signal at the junction 4 preferentially follows the low impedance path, that is the output line 3, and signal 'loss' to the second line section 2' is minimized.

In a practical embodiment, the input lines 1,1' and 2,2', and the amplifying stages 10' and 10'' will generally have the same characteristics, so that the lengths L of the two second line sections 1' and 2' will be identical. Thus, the wanted signal can be selected from either input line by appropriate control of the biasing networks 6' and 7' of the amplifying stage 10' and 6'' and 7'' of the amplifying stage 10''. For efficient transformation, the output impedance of the device 9' or 9'' should be either very high or very low in the 'off' state. With a FET device, such as a high electron mobility transistor (HEMT), the biasing is most easily arranged to provide a low output impedance in the 'off' state. But other devices and other biasing methods can be used which give a high output impedance in the 'off' state. For FET devices, the low output impedance is typically about 5 ohms, but generally would not be more than about 10 ohms. The FET device is found to provide a greater attenuation of the unwanted signal when operated with a low output impedance than when operated with a high output impedance. The low output impedance is transformed at the junction 4 to an impedance which is high relative to the characteristic impedance of the input and output transmission lines (commonly 50 ohms). A minimum of 500 ohms may be regarded as high, but, in other applications, much lower impedances may be used, depending on the gain of the amplifying stage and what is regarded as an acceptable loss of the wanted signal to the other input line.

In a practical embodiment the transmission lines may be formed as stripline on a microstripline board. The impedance matching networks 8',8'',12' and 12'' may then be similarly formed as 'stubs' added to the track of the input lines at an appropriate distance from the FET device. Impedance matching is achieved by determination of this distance and the length of the stub. Some of the biasing components of networks 6',6'' and 7',7'', which may include a low-pass filter to isolate the transmitted signal from the power source for the FET device, can also be formed on the microstripline board substrate. Each of the second lines sections 1' and 2' necessarily includes a d.c. break 5 between the output of its amplifying stage and the junction 4. The d.c. breaks 5 serve to prevent the bias voltage applied to one of the FET devices from reaching the other device. In a microstripline transmission line the d.c. break 5 can be made by interrupting a portion of the second line section with a capacitive coupling. This coupling may comprise a number of thin, closely-spaced parallel strips of track 'interwoven' between the two isolated sections of the input line. The length of these strips constitutes part of the input line and has an effective path length for the signal, which is included in the overall line section length L.

The input lines may be any convenient length L (as shown) which provides the required impedance transformation in the 'off' state of the FET device. The output impedance of the device in the 'off' state inevitably includes a capacitive component additional to the low resistance. This is due largely to the drain-source capacitance of the device. In order to obtain a high impedance at the junction 4 the second line section length L must be increased to take account of this capacitance. The switch is inherently narrow-band, relying on fixed electrical lengths of transmission line. Therefore, the length L of the line sections 1' and 2' should be kept as short as is practically possible to provide the greatest bandwidth and to minimize losses.

Figure 2:
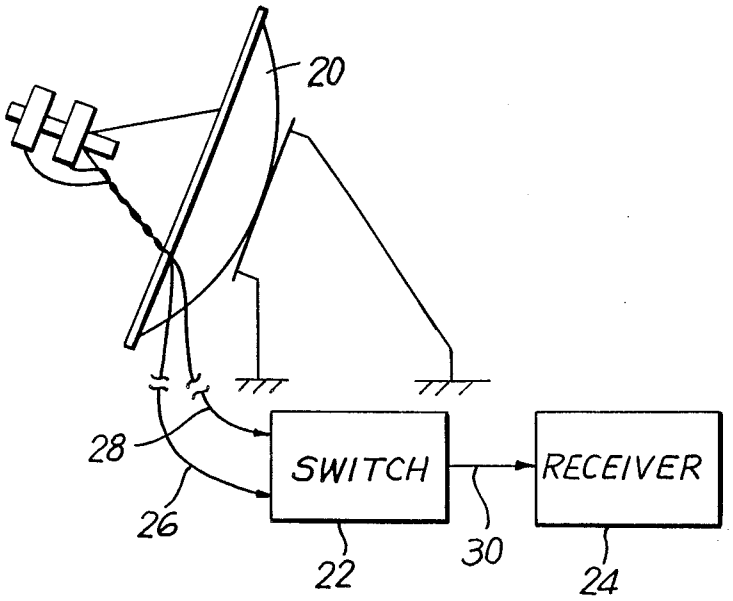
FIG. 2 is a schematic block diagram of the switch of FIG. 1 in a satellite TV receiving system.

The gain of the amplifying stage in the 'on' state depends on the device used, but may be typically 10dB at frequencies around 11GHz using a HEMT device. Greater than 20dB isolation between the two signals at the output transmission line 3 has been achieved. When the switch is used at the front end of a receiving system to select, for example, one of two input signals, the amplifying stage becomes part of the receiving system, and the noise figure of the switch is substantially determined by that of the amplifying stage. The advantage of using the switch in this type of application is either an improved overall noise figure compared to that of a system employing a lossy switch at the front end, which would introduce its own noise to the signal before amplification, or a saving in space and components over using a separate switch after the two input amplifiers. One area of application for the switch is in a satellite TV receiving system 24 (see FIG. 2), where two separate programs may share a common frequency, the signals having different (mutually orthogonal) polarizations. If the receiving antenna 20 is arranged to simultaneously extract the two signals and apply them separately to input transmission lines 26,28 feeding the switch 22, then program selection can be conveniently made by electronic control remote from the receiving antenna 20.

Although the embodiment described has only two input lines, the principle of operation of the switch is equally applicable to an arrangement having a plurality of input lines, the selected input having its amplifier operate in the high gain 'on' state, while the other input amplifiers are biased in the 'off' state. However, as the number of inputs increases, so too does the opportunity for loss of the wanted signal into the 'off' input lines. Thus, the requirement that the 'off' input lines present a high impedance at the junction becomes more stringent if a poor insertion loss figure for the wanted signal is to be avoided.

We claim:

1. A transmission line switch comprising:

(a) a plurality of input lines, (b) a common output line, (c) a junction of said input lines and said output line, (d) respective amplifying means connected in each of said input lines at a predetermined line length from said junction for switching the respective input line 'on' and 'off' selectively, each said amplifying means being operable in an 'on' state in which an input signal is transmitted with gain exceeding unity, and in an 'off' state in which said amplifying means has a predetermined output impedance, said predetermined output impedance and said predetermined line length together presenting a high impedance at said junction to avoid an 'off' input line from loading any 'on' input line, and (e) control means for controlling said amplifying means to operate in said 'on' and 'off' states selectively.

2. A transmission line switch according to claim 1, wherein said input lines and said output line have a common characteristic impedance and said predetermined output impedance is a low impedance relative to said characteristic impedance.

3. A transmission line switch arrangement according to claim 2, wherein each said amplifying means includes a FET device and biasing networks for determining the state of the amplifying means, said control means controlling said biasing networks.

4. A transmission line switch according to claim 3, wherein said FET device is a high electron mobility transistor.

5. A transmission line switch according to claim 3, wherein each said amplifying means includes impedance matching networks to match said FET device to the associated input line.

6. A transmission line switch according to claim 1, wherein said input lines, said output line and said junction are formed as stripline on a microstripline board.

7. A transmission line switch according to claim 6, wherein each said input line incorporates a d.c. break formed as a discontinuity in the stripline.

8. A transmission line switch for switching one of two input signals to an output line, the switch comprising:

(a) two input lines for respective input signals, (b) a common output line, (c) a junction of said input lines and said output line, said input lines, said output line and said junction being formed as stripline on a microstripline board, (d) respective amplifying means connected in each of said input lines at a predetermined line length from said junction, each said amplifying means being operable in an 'on' state in which its input signal is transmitted with gain exceeding unity, and in an 'off' state in which said amplifying means has a predetermined output impedance, said predetermined output impedance and said predetermined line length together presenting a high impedance at said junction, and (e) control means for controlling the two amplifying means to operate a selected one of said amplifying means in said 'on' state and the other amplifying means in said 'off' state, a selected one of said input signals being thereby switched to said common output line.

9. A transmission line switch according to claim 8, wherein each said amplifying means comprises a FET device and biasing networks for determining the state of the amplifying means, said control means controlling said biasing networks.

10. A satellite TV receiving system comprising a receiving antenna, a transmission line switch and a receiver, said transmission line switch comprising:

(a) two input lines for respective input signals, said input signals being two independent orthogonally polarized signals received by said receiving antenna, (b) an output line connected to said receiver, (c) a junction of said input lines and said output line, said input lines, said output line and said junction being formed as stripline on a microstripline board, (d) respective amplifying means connected in each of said input lines at a predetermined line length from said junction, each said amplifying means being operable in an 'on' state in which its input signal is transmitted with gain exceeding unity, and in an 'off' state in which said amplifying means has a predetermined output impedance, said predetermined output impedance and said predetermined line length together presenting a high impedance at said junction, and (e) control means for controlling the two amplifying means to operate a selected one of said amplifying means in said 'on' state and the other amplifying means in said 'off' state, a selected one of said input signals being thereby switched to said output line for detection by said receiver.

* * * * *